United States Patent [19]

Sawyer

[11] 4,418,548

[45] Dec. 6, 1983

[54] VARIABLE CAPACITY MULTIPLE COMPRESSOR REFRIGERATION SYSTEM

[75] Inventor: George N. Sawyer, Flint, Tex.

[73] Assignee: Trane CAC, Inc., La Crosse, Wis.

[21] Appl. No.: 362,830

[22] Filed: Mar. 29, 1982

[51] Int. Cl.[3] ..... F25B 7/00; F25B 1/00

[52] U.S. Cl. ..... 62/175; 62/510; 62/228.3; 137/513.7

[58] Field of Search ..... 62/175, 228 D, 510; 236/1 EA; 137/513.7

[56] References Cited

U.S. PATENT DOCUMENTS

| | | | |
|---|---|---|---|
| 3,126,713 | 3/1964 | Parker | 62/117 |
| 3,775,995 | 12/1973 | Conley et al | 62/196 |
| 3,785,169 | 1/1974 | Gylland, Jr. | 62/468 |
| 3,885,938 | 5/1975 | Ordonez | 62/196 |
| 4,081,691 | 3/1978 | Evalds et al. | 236/1 EA |
| 4,102,149 | 7/1978 | Conley et al. | 62/196 |
| 4,189,929 | 2/1980 | Russell | 62/175 |

*Primary Examiner*—William E. Wayner

[57] ABSTRACT

This invention relates to a refrigeration system having at least two compressors connected in parallel to the refrigeration system suction and discharge lines. Each compressor is adapted to operate singly or in combination in accordance with load requirements. More particularly, this invention relates to a valving arrangement associated with each compressor for preventing refrigerant from condensing in the discharge opening of the idle compressor of such a multiple compressor refrigeration system, and a refrigerant bleed arrangement associated with each compressor which directs refrigerant when present in the discharge of an idled compressor to the system suction line.

8 Claims, 5 Drawing Figures

VARIABLE CAPACITY MULTIPLE COMPRESSOR REFRIGERATION SYSTEM

BACKGROUND OF THE INVENTION

In many refrigerant systems, capacity modulation is a desirable feature. Capacity modulation is especially desirable in air conditioning and heat pump applications when the load varies during the season. During periods of part-load operation, compressor capacity is reduced, resulting in a close match between the system capacity and the load which results in the system operating at a higher efficiency.

It is known to provide two or more compressors to be connected in parallel to a single refrigeration system and to selectively cycle either of the compressors off or on to provide variable capacity for the system. Operation of compressors in parallel poses certain problems arising from the different temperature and pressure levels which may be attained by each compressor. Generally, the pressure drop in the suction manifold leading to the compressor must be of a small value and uniform to each compressor. Oil equalization means must be provided between compressors since oil will tend to accumulate in the sump of the running compressor. Another problem confronting parallel compressor systems is that when a compressor in the system is deenergized condensed liquid refrigerant and oil may accumulate in the discharge system of the non-operating compressor. When the non-operating compressor is energized, the liquid refrigerant, if present in the discharge valve cavities, muffler, and discharge line, puts an abnormal strain on the starting compressor that can, because of slugging, result in discharge valve damage and premature compressor failure.

In some prior art teachings, such as that disclosed in U.S. Pat. No. 3,126,713-Parker, a multiple compressor system includes a check valve for preventing accumulation of liquid refrigerant in the discharge system of one of the compressors. When only one compressor is protected from refrigerant condensing in its discharge system, the sequence of operations must always include energizing the primary compressor in response to a first condition and both primary and secondary compressors in response to a second condition. If the secondary compressor were to operate independently of the primary compressor, refrigerant condensation would result in the then-idle primary compressor discharge system. For this type system to be effective, the primary compressor must be operating when the secondary compressor is energized.

By the present invention, a multiple compressor refrigerant system includes valve means associated with each compressor which assures that condensed refrigerant and oil will not collect in the discharge system of any compressor in the system when it is idle.

SUMMARY OF THE INVENTION

A variable capacity multiple compressor refrigeration system is provided wherein the discharge ports of each compressor are connected in parallel to the discharge line of the system and the suction ports are connected in parallel to the suction line of the system. A check valve associated with the discharge system of each compressor is arranged so that the valve associated with an active compressor will allow the active compressor to pump refrigerant into the discharge line of the refrigeration system while the valve associated with an idle compressor prevents high pressure refrigerant in the discharge line from entering the discharge system of any idle compressor. A bleed system is provided that will direct any refrigerant that may leak past the check valve associated with the idle compressor into the suction line of the refrigeration system and also prevent discharged refrigerant from being short circuited to the suction line when a compressor is running.

An object of the present invention is to provide a multiple compressor refrigeration system wherein each compressor is adapted to operate singly or in combination having valve means therein for preventing refrigerant liquid from accumulating in the discharge of an idle compressor and subsequently causing compressor failure.

Another object of the invention is to provide a refrigeration system having at least two compressors operable singly or in combination with valve means for preventing high pressure refrigerant from an operative compressor from entering the discharge system of an idle compressor, and means for bleeding refrigerant when present in the discharge system of the idle compressor to the suction manifold of the refrigeration system.

Another object of the present invention is to provide a refrigeration system having two compressors, including a check valve and bleed means associated with the discharge system of each compressor for allowing refrigerant from the operating compressor to enter the discharge manifold of the refrigeration system while preventing refrigerant from the discharge manifold from entering the discharge system of the idle compressor, and for bleeding refrigerant when present in the discharge system of the idle compressor to the suction manifold of the refrigeration system.

DESCRIPTION OF THE PREFERRED EMBODIMENT

Figure 1:
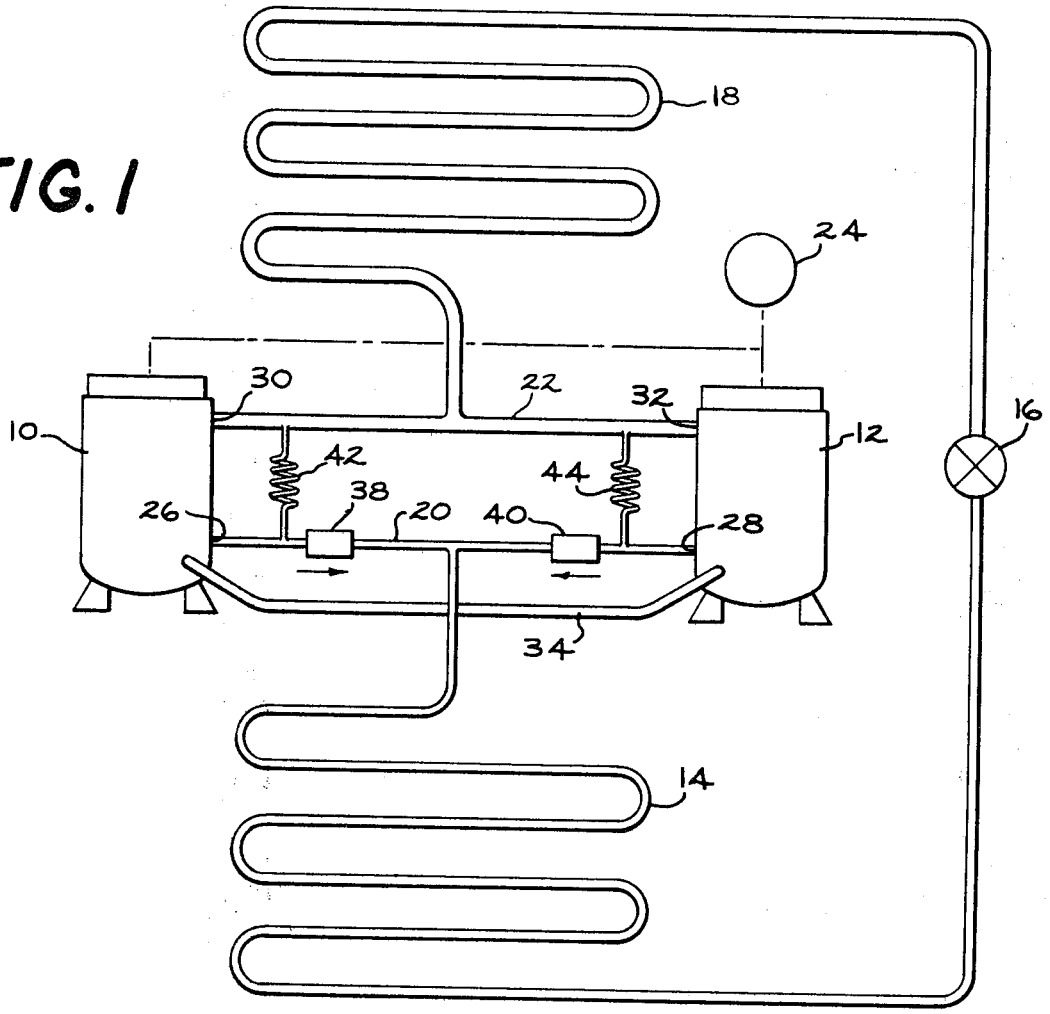
FIG. 1 is a schematic diagram of a refrigeration system embodying the present invention.

As best shown in FIG. 1, a pair of refrigerant compressors 10 and 12 are shown connected to a refrigeration system including a condenser 14, expansion device 16, and evaporator 18 connected in series between a discharge manifold 20 and a suction manifold 22. While in the present instance only two parallel compressors are shown, it should be evident from the following description that any number of compressors arranged in parallel may be employed in carrying out the present invention. The compressors 10 and 12 form the means for compressing refrigerant selectively at generally full and reduced capacities represented by operating both or either one of the compressors according to signals from the controlling means therefor, formed by the control panel 24. In the event several compressors were employed in the refrigeration system, the control employed would provide signals capable of operating the compressors either singly, in any combination needed, or all of them for maximum capacity.

The compressors are connected in parallel between the common discharge line or manifold 20, and suction line or manifold 22. To this end the compressors 10 and 12 have their respective discharge system outlets represented generally at 26 and 28 connected to the common discharge manifold 20. The discharge system is meant to include at least the discharge line leading from the discharge outlet of the compressor, including the discharge valve. The suction systems outlets designated generally at 30 and 32 of compressors 10 and 12, respectively, are connected to the compressor suction manifold 22. The compressors 10 and 12 employed in the present instance are of the low-side type wherein the shell or outer casing of an operating compressor is at substantially suction pressure. The oil sump areas (not shown), generally in the lower portion of the compressors 10 and 12, are connected by an oil equalization line 34 which will allow the oil in the dump areas to seek its own level and generally divide equally between the two compressors. However, when only one compressor is operating the suction pressure in that shell will be reduced. Due in part to this pressure differential between the operating compressor which is at the lower normal pressure, oil from the idle compressor will migrate into the casing of the operating compressor. Eventually, all of the oil will be drained out of the idle compressor and at the next start-up of the oil-starved compressor will result in damage and premature failure. To prevent this from happening, the oil equalization line 34 is connected to each compressor sump at a mutual minimum oil level so that no oil can be drained from the idle compressor below the minimum level, thus insuring a sufficient amount of oil to be present in the not-running compressor for its subsequent start-up operation.

As mentioned above, the discharge systems 26 and 28 of the compressors 10 and 12, respectively, are interconnected to the discharge manifold 20. When only one compressor of a parallel compressor system is operating, the discharged refrigerant from manifold 20 will, if not checked, due to pressure and temperature differential, accumulate in the area of the discharge system of a non-operating compressor. The presence of liquid refrigerant and/or oil in the discharge system of an idle compressor when present during the start-up of the idle compressor will result in strain on the compressor and discharge valve damage leading to possible premature failure.

By the present invention, means are provided for assuring that condensed refrigerant and oil will not collect in the discharge system of any one of the compressors that may be off or idle. To this end, the discharge systems 26 and 28 of each compressor in the system are isolated from the discharge manifold 20 by check valves 38 and 40 associated with each discharge system outlet 26 and 28. While the valves 38 and 40 are shown schematically positioned in the refrigeration system and externally of the compressor, it should be noted that a valve may be incorporated as part of each compressor discharge system and positioned internally within the compressor casing. The check valves 38 and 40, as will be explained, are so arranged between each compressor discharge system outlets 26, 28 and the discharge manifold 20 that the running compressor can pump refrigerant through its associated valve into the discharge manifold 20 while the check valve associated with the idle compressor prevents the reverse flow from entering the discharge system outlet of the idle compressor when only one of the compressors is running. In operation, each valve is similar and, accordingly, only one will be explained. Assuming compressor 10 is operating and compressor 12 is idle, then refrigerant discharged through compressor discharge system outlet 26 will flow through its associated valve 38 in the direction of the arrow into the manifold 20 and to condenser 14. The valve 40 associated with the discharge system outlet 28 of compressor 12 will prevent refrigerant from entering the discharge 28 of the idle compressor. In effect, the valve associated with each discharge system outlet will prevent the accumulation of refrigerant therein when that compressor is idle.

From a practical point, the type of valve that can generally be applied from a cost factor may not seal perfectly. When this is the case, some of the high pressure gaseous refrigerant discharged from the running compressor may, over a period of time, seep by the valve associated with the idle compressor and condense and collect in the discharge system of the idle compressor. To overcome this problem, a very small controlled leak between each of the compressor's discharge systems and its associated valve to the suction manifold 22 is provided. To this end, a small bore capillary tube 42 is connected at one end between the discharge system 26 and its associated valve 38, and at its other end to the suction manifold 22, and a similar small bore capillary tube 44 is connected at one end between the discharge system 28 and its associated valve 40, and at its other end to the suction manifold 22. Due to the pressure differential present between the discharge system of the idle compressor 28 and the suction manifold 22, any refrigerant present in the discharge system of the idle compressor will flow to the suction manifold and back into the refrigeration system. This arrangement will effectively purge condensed refrigerant from the discharge system of the idle compressor.

It should be noted that this type of controlled leak is also present in the discharge system when its associated compressor is operating and that a small portion of the discharged refrigerant from the operating compressor would, in this instance, leak directly into the suction manifold, resulting in a relatively small loss of efficiency. In most instances, this relatively small leakage of discharge refrigerant from the discharge system of the running compressor to the suction manifold is not significant and can be tolerated. In the event that a particular refrigeration system cannot tolerate the small amount of refrigerant being short circuited when a compressor is running, means are provided by the present invention that eliminates the short circuiting of refrigerant between the discharge system of the running compressor and the suction manifold but will still provide a leak or bleed for liquid refrigerant that may leak past the valve associated with the discharge system of the idle compressor.

Figure 2:
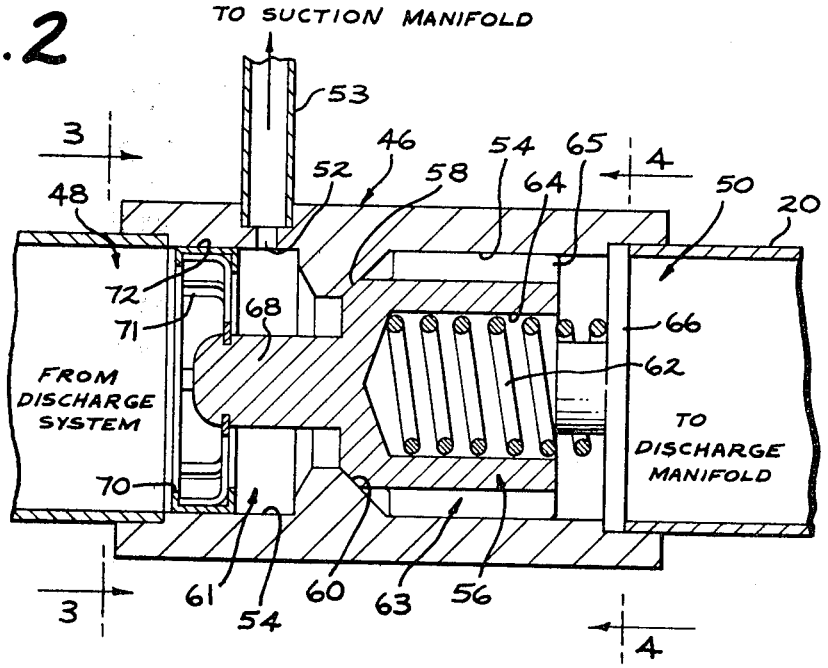
FIG. 2 is a cross-sectional view of one form of a valve incorporated in the present invention.
Figure 4:
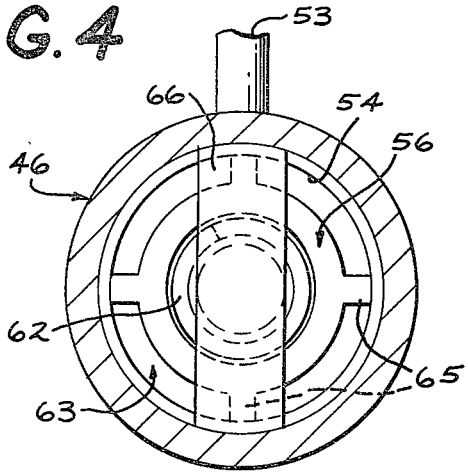
FIG. 4 is a cross-sectional view taken along line 4—4 of FIG. 2.
Figure 3:
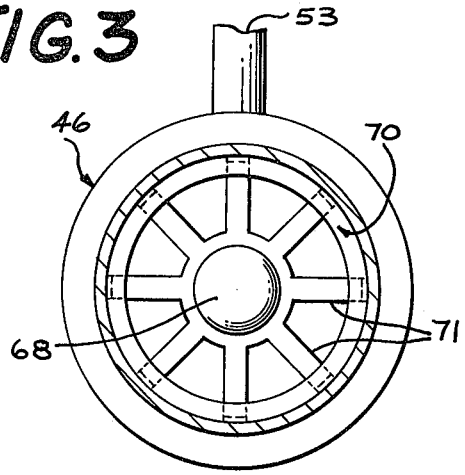
FIG. 3 is a cross-sectional view taken along line 3—3 of FIG. 2.

Referring now to FIG. 2, there is illustrated one form of a check valve that may be employed in carrying out the present invention in place of the valves 38 and 40. In this form of the invention the check valve and bleed system function as a single unit. The valve body comprises a cylindrical housing or casing 46 formed with an inlet 48 which is connected to the discharge system of its associated compressor, an outlet 50 which may be connected to the discharge manifold 20 and a bleed outlet 52 which is connected to the suction manifold 22 through a bleed line 53 similar to the capillaries 42, 44 of FIG. 1. Movable within the bore 54 defined in the cylindrical casing 46 is a piston 56. Formed on one axial end of the piston 56 is a valve portion 58, which is adapted to enage valve seat 60. The valve seat 60 is formed on the inner wall of the bore 54 and, in effect, divides the bore 54 into an upstream area 61 and a downstream 63. The piston 56 is biased by a spring 62 so that valve portion 58 in its rest position is against the valve seat 60. The spring 62 is disposed in a cavity 64 formed in piston 56 and acts between the bottom wall of the cavity 64 and a retaining member 66 positioned in the downstream end of the casing 54. To insure fluid flow past the piston 56 and outlet 50 the member 66 as shown in FIG. 4 is a relatively narrow strip extending across outlet 50. The piston is formed to provide a plurality of radially extending projection arms 65, as shown in FIG. 4, that permit fluid flow past the piston in its open position. The upstream end 68 of piston 56 extends axially past the valve seat portion area 58 and into the upstream area 61 of bore 54. Secured to the end portion 68 is a bleed valve member 70 having a substantially flat circumferentially disposed valve face 72 that slidably engages the inner surface of area 61. Formed in the wall of casing 46 and communicating with the area 61 is a bleed hole 52 which is adapted to be connected to the suction manifold 22 through the bleed line 53, explained hereinbefore. To insure proper fluid flow through the area 61 of bore 54, the valve 70 consists of a plurality of spokes 71 secured to and generating radially from the end 68 to support the valve face 72.

In operation, the high pressure refrigerant discharged by the running compressor will move the piston 56 of the valve associated with the running compressor axially against action of the biasing spring 62 to unseat the valve portion 58 from seat 60, thereby allowing refrigerant to flow into the discharge manifold 20 and to the refrigeration system condenser 14. At the same time, as the valve portion 58 moves away from its valve seat 60, the valve face 70 moves axially to cover the bleed hole 74, thereby preventing discharged refrigerant from bleeding directly into the refrigeration system suction manifold 22. In operation, the valve associated with an idle compressor remains in its normal or neutral position shown in FIG. 2 and refrigerant will be flowing from the discharge manifold and against the piston 56 to assist in maintaining the valve portion 58 against its valve seat 60. In this position, the valve surface 72 is in the position shown in FIG. 2 and, accordingly, any small amount of refrigerant that may leak past valve portion 58 will be drawn through bleed opening 52 and into the suction manifold, as mentioned above.

As can be seen by the present invention a multiple compressor refrigeration system has been provided with a valving system to operate singly and in combination in a manner that prevents high pressure refrigerant discharged by an operating compressor from entering the discharge system of an idle compressor. Further, the valve system provides a bleed system that will purge refrigerant when present in the discharge system of an idle compressor while preventing discharged refrigerant from a running compressor to be bled directly into the suction manifold. It should be noted that the present valving system can be applied to any number of parallel connected compressors and at least two are shown.

Figure 5:
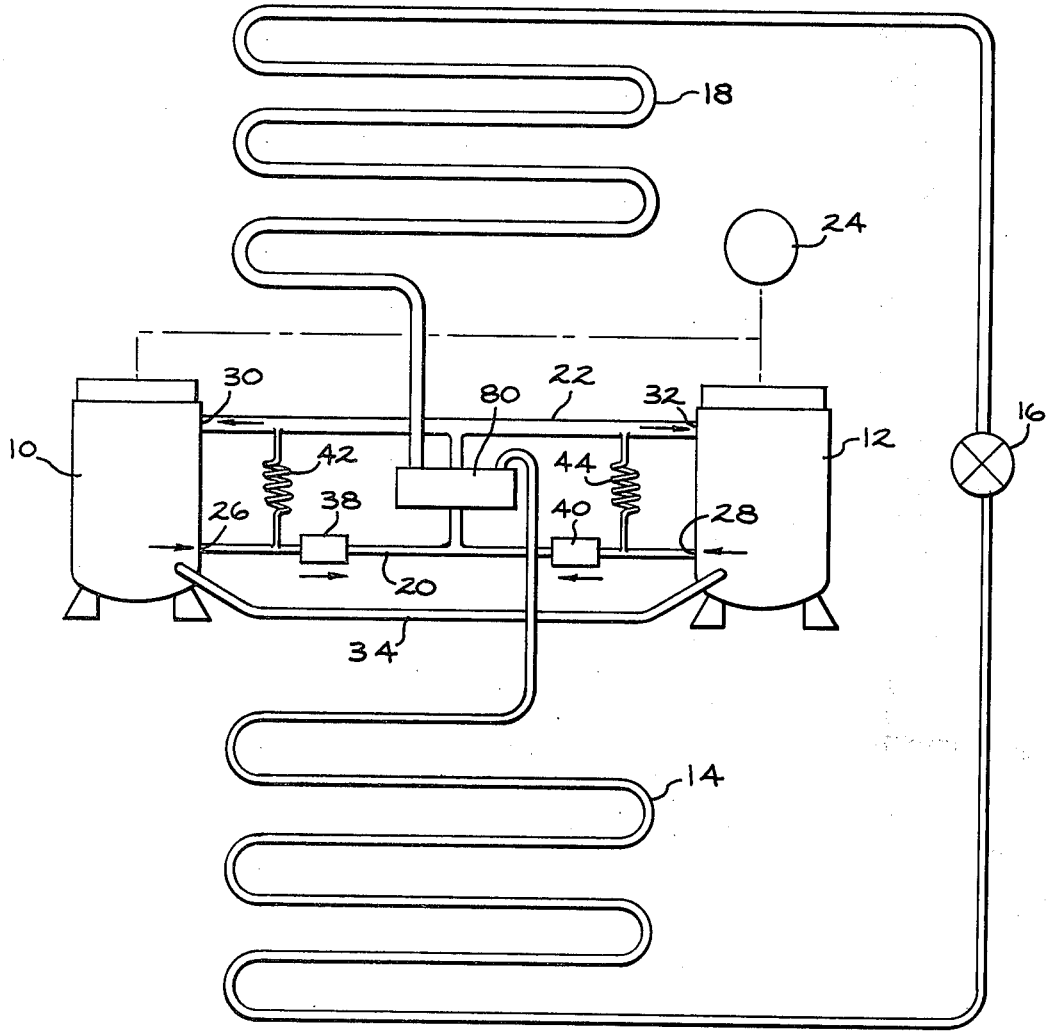
FIG. 5 is a schematic diagram similar to FIG. 1 showing the present invention in a heat pump refrigeration system.

With reference to FIG. 5, there is shown a refrigeration heat pump system in conjunction with the valving system of the present invention wherein a switchover valve 80 of the known type is employed so that either heat exchanger 14 or 18 can be connected to the suction manifold 22 or discharge manifold 20 to function interchangeably as an evaporator or condenser. All of the components of the system similar to those described with reference to the embodiment of FIGS. 1–4 are designated by the same reference numerals shown therein.

It should be apparent to those skilled in that art that the embodiment described heretofore is considered to be the presently preferred form of this invention. In accordance with the Patent Statutes, changes may be made in the disclosed apparatus and the manner in which it is used without actually deprting from the true spirit and scope of this invention.

What is claimed is:

1. A multiple compressor refrigeration system including at least two hermetic shell compressors, each having a discharge system for discharging high pressure refrigerant and a suction system for returning low pressure refrigerant to said compressor, a discharge manifold means interconnecting the discharge systems of said compressors, and suction manifold means interconnecting the suction systems of said compressors arranging said compressors in parallel, a first heat exchanger connected to said suction manifold intermediate said suction system openings and a second heat exchanger connected to said discharge manifold intermediate said discharge system openings, comprising:

control means for energizing one of said compressors in response to a first condition, and another of said compressors, in response to a second condition and both of said compressors in response to a third condition;

refrigerant flow control means including a check valve associated with the discharge system of each of said compressors, that includes a sealing member movable within a valve body, said check valve being operable for permitting high pressure refrigerant flow between the discharge system of its associated compressor and said discharge manifold when said compressor is energized and for preventing high pressure refrigerant present in said discharge manifold when another one of said compressors is energized from entering the discharge system of said associated compressor when it is de-energized; and bleed means arranged between each of said check valves and its associated compressor, said bleed means comprising a bleed valve member connected to the check valve sealing member, and operable when actuated thereby to bleed refrigerant present in the discharge system of its associated compressor to said suction manifold.

2. The multiple compressor refrigeration system recited in claim 1 wherein said bleed means includes a conduit connected at one end between the discharge system of its associated compressor and check valve and connected at its other end to said suction manifold.

3. The multiple compressor refrigeration system recited in claim 1 further including an oil equalizing conduit connected between the shell of the compressor at a height of minimum desired oil level to be maintained in an idle compressor.

4. The multiple compressor refrigeration system of claim 1 wherein said check valve sealing member comprises a piston that engages a valve seat formed in the valve body and which extends on one end to connect with the bleed valve member, so that when the piston moves within the valve body, it moves the bleed valve member.

5. A multiple compressor refrigeration system including a first hermetic shell compressor having a discharge and suction systems, a second hermetic shell compressor having discharge and suction systems, a discharge manifold means interconnecting the discharge systems of said compressors, and a suction manifold means interconnecting the suction systems of said compressors arranging said first and second compressors in parallel, a first heat exchanger connected to said suction manifold intermediate said suction system openings and a second heat exchanger connected to said discharge manifold intermediate said discharge system openings, comprising:

control means for energizing said first compressor in response to a first condition, said second compressor in response to a second condition, and both of said compressors in response to a third condition;

a first check valve associated with the discharge system opening of said first compressor being operable when said first compressor is running for permitting refrigerant flow between said first compressor and said discharge manifold and for preventing passage of refrigerant from said first compressor to said second compressor when said second compressor is idle;

a second check valve associated with the discharge system opening of said second compressor being operable when said second compressor is running for permitting refrigerant flow between said second compressor and said discharge manifold and for preventing passage of refrigerant from said discharge manifold to said first compressor when said first compressor is idle; and bleed means associated with said first and second valves arranged for directing refrigerant when present in the discharge opening of an idled compressor to said suction line, said bleed means comprising a generally annular member disposed within a cylindrical valve body and operative to open and close a bleed port as the annular member is moved within the valve body.

6. The multiple compressor refrigeration system recited in claim 5 wherein said bleed means includes a conduit connected at one end between the discharge system of its associated compressor and valve means at the bleed port and connected at its other end to said suction manifold.

7. The multiple compressor refrigeration system recited in claim 5 wherein said first and second check valves associated with the discharge system of said compressors each includes a first valve portion operable for permitting high pressure refrigerant flow between the discharge system of its associated compressor and said discharge manifold when said compressor is energized and for preventing high pressure refrigerant present in said discharge manifold when another one of said compressors is energized from entering the discharge system of said associated compressor when it is de-energized, and a second bleed valve portion including the annular member, operable with said first portion for bleeding refrigerant when present in the discharge system of its associated compressor to said suction manifold.

8. The multiple compressor refrigeration system recited in claim 7 further including an oil equalizing conduit connected between the shell of the compressor at a height of minimum desired oil level to be maintained in an idle compressor.

* * * * *